US008245419B2

(12) United States Patent
Echols

(10) Patent No.: US 8,245,419 B2
(45) Date of Patent: Aug. 21, 2012

(54) INTEGRAL ANKLE SUPPORT FOR A SHOE

(76) Inventor: Tony Ryan Echols, Paulding, OH (US)

( * ) Notice: Subject to any disclaimer, the term of this patent is extended or adjusted under 35 U.S.C. 154(b) by 516 days.

(21) Appl. No.: 12/457,767

(22) Filed: Jun. 19, 2009

(65) Prior Publication Data

US 2010/0319217 A1 Dec. 23, 2010

(51) Int. Cl.
*A43B 7/20* (2006.01)

(52) U.S. Cl. ..... 36/88; 36/89; 36/114

(58) Field of Classification Search ..... 36/88, 89, 36/92, 93, 114, 45
See application file for complete search history.

(56) References Cited

U.S. PATENT DOCUMENTS

| | | | | | |
|---|---|---|---|---|---|
| 398,892 | A * | 3/1889 | Golden | 602/65 |
| 674,066 | A * | 5/1901 | Mitchell | 602/65 |
| 746,338 | A * | 12/1903 | Keen | 54/82 |
| 1,397,095 | A * | 11/1921 | Hamilton | 602/65 |
| 2,942,359 | A * | 6/1960 | Bushway et al. | 36/89 |
| 3,237,319 | A * | 3/1966 | Hanson | 36/117.6 |
| 3,750,310 | A * | 8/1973 | Messner et al. | 36/117.6 |
| 4,385,456 | A * | 5/1983 | Livernois et al. | 36/115 |
| 4,724,627 | A * | 2/1988 | Sisco | 36/117.6 |
| 5,449,005 | A * | 9/1995 | Echols | 128/882 |
| D383,513 | S * | 9/1997 | Ryan et al. | D2/973 |
| 5,946,827 | A * | 9/1999 | Okajima | 36/58.5 |
| 6,079,128 | A * | 6/2000 | Hoshizaki et al. | 36/89 |
| 6,766,599 | B2 * | 7/2004 | Baek | 36/117.6 |
| 7,010,823 | B2 * | 3/2006 | Baek | 12/142 P |
| 2005/0210709 | A1 * | 9/2005 | Labonte | 36/89 |
| 2011/0173841 | A1 * | 7/2011 | McDuff | 36/89 |

* cited by examiner

*Primary Examiner* — Marie Patterson
(74) *Attorney, Agent, or Firm* — Jacobson Holman PLLC

(57) ABSTRACT

An integral ankle support for a shoe has a support element and a cushioning element. The support element has horizontally elongated, generally parallel, and panel-like edge upstanding wings having corresponding front and rear ends joined at their rear ends by an integral, curved, and edge upstanding bight panel portion. The support element is constructed of semi-rigid, but partially flexible, material that is lightweight and moldable. The support element has a bottom tab that is oriented substantially perpendicular to the wings and that extends inwardly under the insole of the shoe. The ankle cushioning element is located on the inner surfaces of the rear ends of the wings and the central portion of the lower margin of the bight panel portion. The ankle support is incorporated as part of the internal structure of the shoe so as to remain fixed in place and provide enhanced support to the wearer's foot.

12 Claims, 6 Drawing Sheets

INTEGRAL ANKLE SUPPORT FOR A SHOE

BACKGROUND OF THE INVENTION

1. Field of the Invention

The present invention generally relates to an ankle support that is an integral part of a shoe. More specifically, the present invention relates to an ankle support that is an internal and integral component of the shoe, is flexible enough to mold to the shape of the wearer's foot, and yet rigid enough to provide enhanced support to the ankle portion of the wearer's foot.

2. Description of the Prior Art

Various forms of ankle and interior shoe bracing devices are known. Examples of these previously known devices are disclosed in U.S. Pat. Nos. 3,237,319, 3,834,377, 4,385,456, 4,821,743, and 5,175,947.

An insertable athletic shoe insert is described in the present inventor's U.S. Pat. No. 5,449,005. The insert is attached to the ankle and heel portion of the interior of the shoe by thistle-type fastening strips. A possible drawback associated with such removable inserts is that the device may separate from the thistle-type fastening strips during wear and shift within the shoe, thus requiring frequent readjustment. The shifting of the removable insert may also create friction that might lead to callouses on the foot and ankle.

Therefore, a need exists for an ankle support that provides the requisite amount of support and is comfortable, but that remains securely fixed in place during wear.

SUMMARY OF THE INVENTION

The present invention overcomes the above-described limitations of the prior art by providing an ankle support that is a built-in component of the shoe. The invention provides the requisite amount of foot support and is comfortable, but remains securely fixed in place during wear.

In general, the ankle support, which is located out of sight within the walls of the shoe, includes a support element and a cushioning element. The support element is structurally strong yet partially flexible, and is configured to prevent lateral and medial rolling of the ankle. The support element is constructed of lightweight plastic that while in general is rigid enough to provide the requisite degree of ankle support, but is still flexible enough at body temperature to be moldable to the shape of the wearer's foot. The cushioning element provides both comfort to the ankle portion of the wearer's foot, and additional ankle support. The ankle support is an integral and permanent part of the shoe structure, with both the shoe and the ankle support assembled together.

According to a preferred embodiment of the present invention, the support element is generally U-shaped and includes a pair of generally parallel wings interconnected at one pair of corresponding ends by a curved bight panel portion. The bight panel portion and the wings are generally panel-like in configuration.

The support element is located within the shoe with the curved bight portion disposed at the heel of the shoe and the wings of the support element extending forwardly from the heel along opposite side interior portions of the shoe. The forward ends of the wings of the support element are relatively low in height as opposed to the rear ends of the wings and the curved bight portion of the support element. The lower margin of the curved bight portion of the support element is elevated relative to the lower margins of the wings of the support element. The upper margins of the rear ends of the wings of the support element and the curved bight portion of the support element are disposed at an elevation above that elevation which corresponds to the malleolus bone (i.e., ankle) area of the foot. To conform generally to the shape of the wearer's foot, the wings of the support element are concavo-convex with their concave sides opposing each other.

One feature of the present invention is that the support element is semi-rigid, i.e., structurally strong so as to provide the requisite amount of ankle support, yet partially flexible so as to conform in general to the wearer's foot.

Another feature of the invention is that the support element is an internal part of the shoe in that it is located between the shoe upper and the interior lining of the shoe so as to remain in place. According to one embodiment of the invention the support element has a bottom tab that is oriented substantially perpendicular to the support element wings and extends inwardly under the insole, i.e., below the insole and between a portion of the lining and a portion of the upper that are substantially parallel to the insole, so as to ensure that the ankle support remains securely fixed in place.

According to another embodiment of the invention, the support element terminates at a bottom edge of the support element wings and is secured to the upper with stitching and/or an adhesive so as to ensure that the ankle support remains securely fixed in place.

Still another feature of the invention is that the ankle support includes a cushioning element on the side of the opposed wings of the support element that face the wearer's foot. That is, the support element is layered with cushioning on the inside of the support element that surrounds the ankle area. The cushioning element can include, for example, neoprene padding or gel padding, or other such materials that provide the desired cushioning effect. The cushioning element is moldable so as to conform to the foot shape and thus provide enhanced comfort for the wearer.

Yet another feature of the present invention is that the support element has a pair of notches in the rear portion thereof, i.e., in proximity to the Achilles tendon of the wearer. One notch in an upper part of the rear portion extends to the opposite side of the ankle, and another notch at the bottom near the heel area of the foot also extends to the opposite side of the ankle. The notch in the support element provides for the requisite degree of both planter and dorsal flexion of the wearer's foot.

Still another feature of the present invention is that by virtue of providing increased support for the wearer's ankle, the ankle support may provide for enhanced wearer performance. For example, by maintaining the wearer's foot in a more stabilized position, the ankle support can provide for improved leaping ability. That is, by virtue of the added ankle support, the foot and the ankle are properly aligned, which relieves the stress associated with improper balancing of the foot and ankle. Because the alignment of the foot and ankle is improved, more muscles are enabled to fully engage with one another. This condition means that the vertical leaping ability of the wearer may therefore increase.

Yet another feature of the present invention is that by virtue of providing increased support for the wearer's ankle, the potential for certain types of foot injuries is reduced. For example, since the ankle support helps to prevent over-extension of the wearer's foot, the potential for ligament injury is reduced. In fact, over time, use of the ankle support should serve to increase the tensile strength of the ligaments in the wearer's ankle.

An object of the present invention, therefore, is to provide an ankle support that is a built-in component of a shoe, that provides the requisite amount of lateral foot support yet is still comfortable, and that remains securely fixed in place during wear.

Another object of this invention is to provide an ankle support that has both a support element and a cushioning element.

Still another object of this invention is to provide an ankle support having a support element that in general is rigid enough to provide the requisite degree of ankle support, yet is still flexible enough at body temperature to be moldable to the shape of the wearer's foot.

Another object of this invention is to provide a support element that is an internal part of the shoe in that it is located between the shoe upper and the interior lining of the shoe so as to remain in place.

Yet another object of this invention is to provide an ankle support having a support element with a bottom tab that is oriented substantially perpendicular to the wings and that extends inwardly under the insole, i.e., below the insole and between a portion of the lining and a portion of the upper that are substantially parallel to the insole, so as to ensure that the ankle support remains securely fixed in place.

Another object of this invention is to provide an ankle support having a support element that terminates at a bottom edge of the support element wings and is secured to the upper with stitching and/or an adhesive so as to ensure that the ankle support remains securely fixed in place.

Another object of this invention is to provide an ankle support having a moldable cushioning element on the side of the opposed wings of the support element that face the wearer's foot so as to conform to the foot shape and thus provide enhanced comfort for the wearer.

Another object of this invention is to provide an ankle support having a support element with a pair of notches in the rear portion thereof so as to provide for the requisite degree of both planter and dorsal flexion of the wearer's foot.

Yet another object of the present invention is to provide an ankle support that can increase the performance capability of a wearer by providing for greater stability of the foot.

Another object of the present invention is to provide an ankle support that can, in effect, increase the tensile strength of the ligaments in the wearer's ankle.

Still another object of the present invention is to provide an item of footwear that incorporates the aforementioned ankle support.

Another object of this invention to be specifically enumerated herein is to provide an ankle support in accordance with the preceding objects that will conform to conventional forms of manufacture, be of relatively simple construction and easy to use so as to provide a support that will be economically feasible, long lasting, durable in service, relatively trouble free in operation, and a general improvement in the art.

These together with other objects and advantages which will become subsequently apparent reside in the details of construction and operation as more fully hereinafter described and claimed, reference being had to the accompanying drawings forming a part hereof, wherein like reference numbers refer to like parts throughout. The accompanying drawings are intended to illustrate the invention, but are not necessarily to scale.

DETAILED DESCRIPTION OF THE PREFERRED EMBODIMENTS

Figure 1:
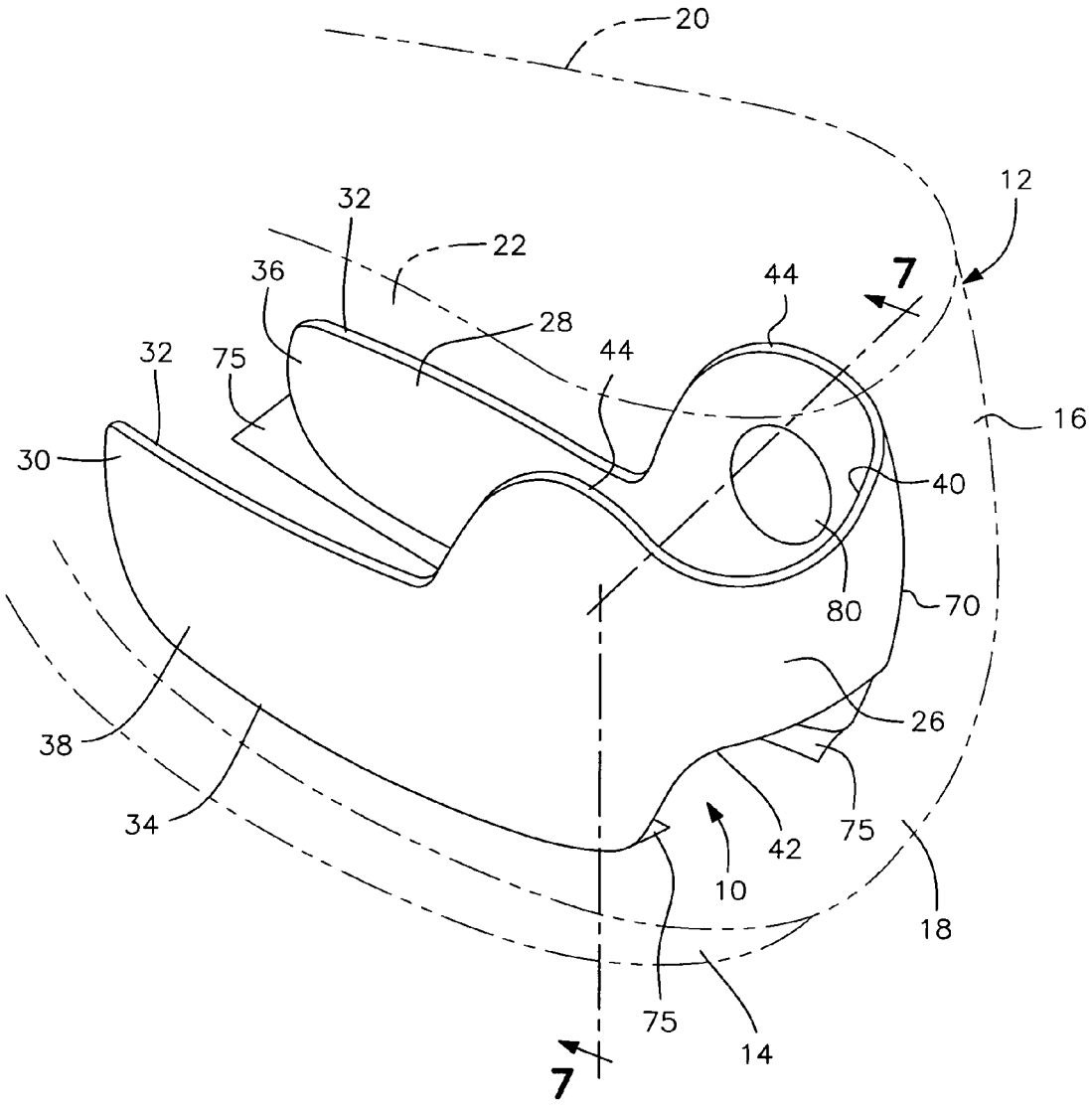
FIG. 1 is a perspective view of an ankle support constructed in accordance with a first embodiment of the present invention in position within a shoe.

Although preferred embodiments of the invention are explained in detail, it is to be understood that other embodiments are possible. Accordingly, it is not intended that the invention is to be limited in its scope to the details of constructions, and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents that operate in a similar manner to accomplish a similar purpose. Where possible, components of the drawings that are alike are identified by the same reference numbers.

Figure 5:
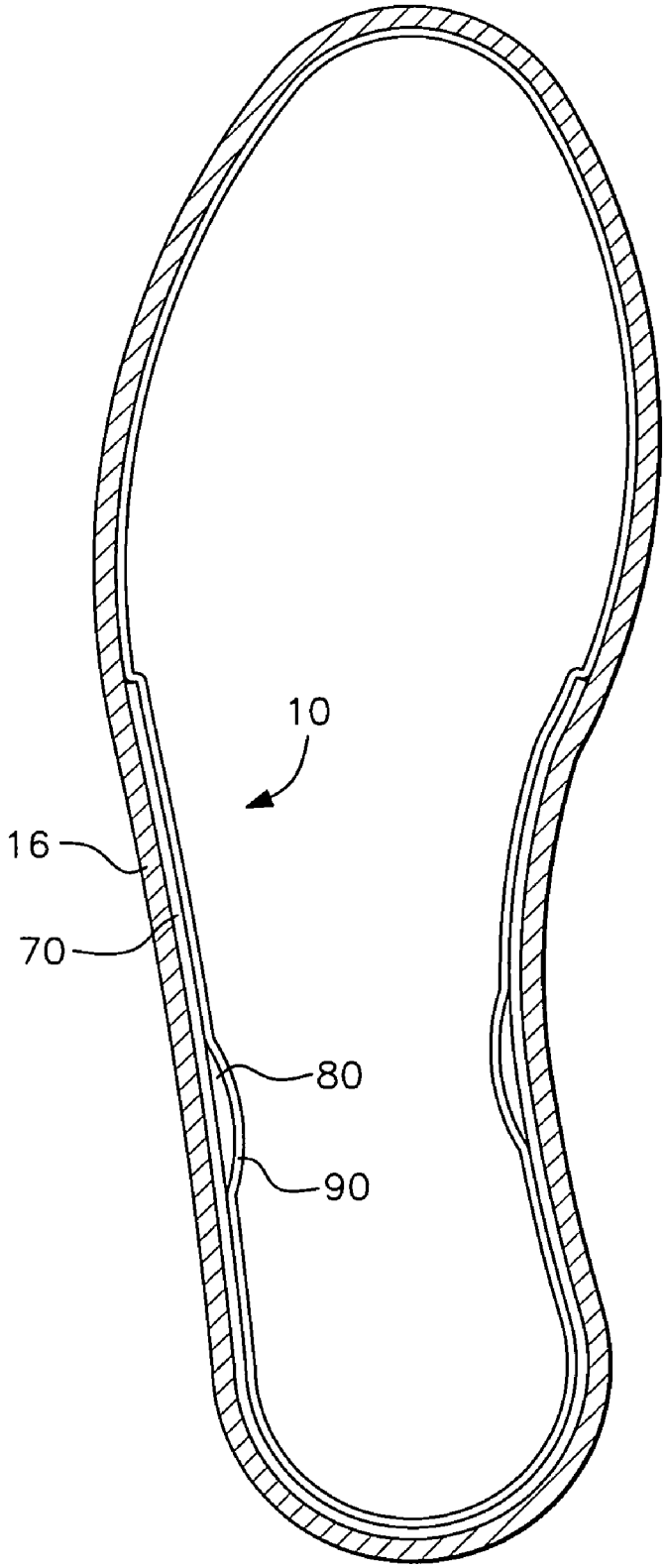
FIG. 5 is a cross-sectional plan view of the ankle support shown in FIG. 1 with the ankle support assembled within the shoe.
Figure 7:
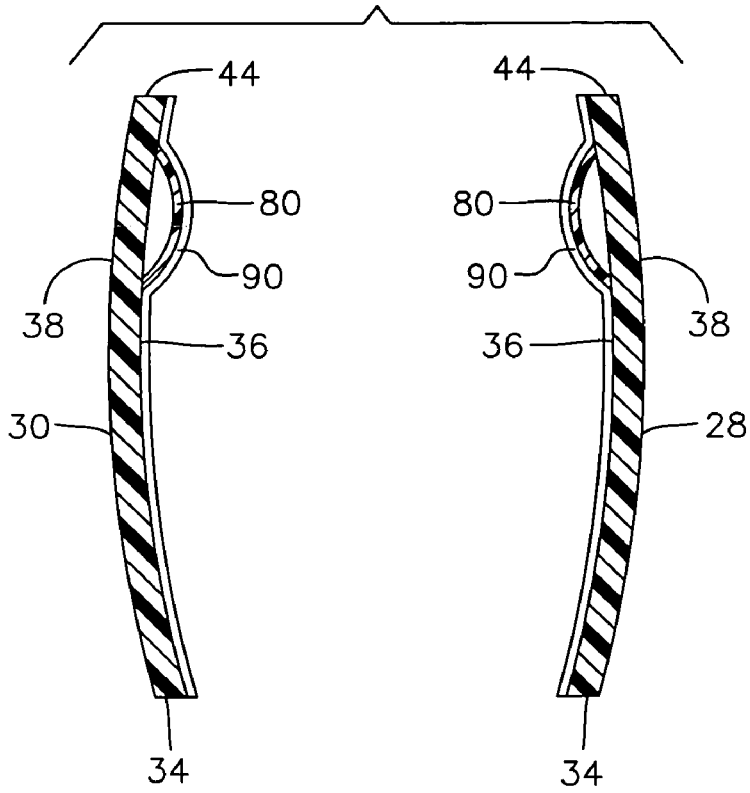
FIG. 7 is an enlarged partial cross-sectional rear view of the ankle support taken along line 7-7 in FIG. 1 with the ankle support assembled within the shoe.

Referring now specifically to FIG. 1 of the drawings, an ankle support in accordance with a first embodiment of the present invention is generally designated by reference number 10. The ankle support 10 is shown in conjunction with an item of footwear, referred to hereinafter for ease of description as a "shoe" 12. The ankle support 10 includes in general a support element 70 and a cushioning element 80. The ankle support 10 is an internal and thus integral part of the shoe 12 in that the ankle support is, in general, located between the shoe upper 16 (see also FIGS. 5 and 6) and an interior lining 90 of the shoe 12 so as to remain in place.

Figure 10:
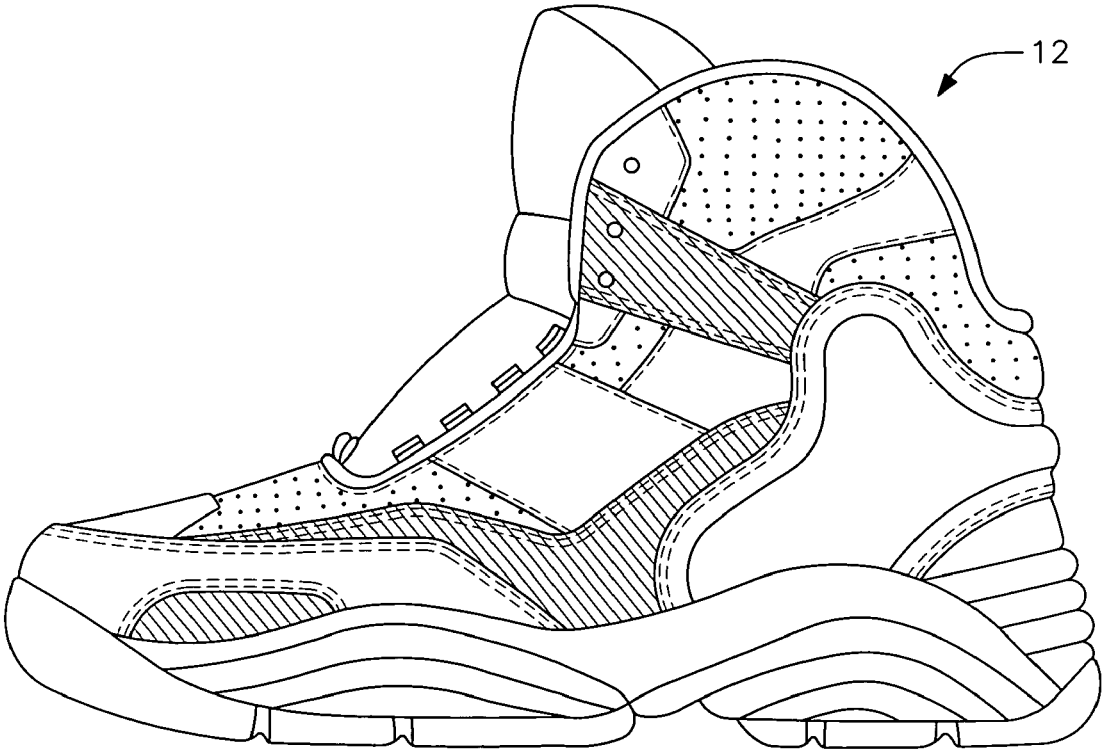
FIG. 10 is a side view of an athletic shoe that includes an ankle support in accordance with the present invention.

For purposes of illustration, the ankle support 10 is described in conjunction with a shoe 12 that is an athletic shoe, shown in FIG. 10. As shown in FIG. 1, the athletic shoe 12 includes an outsole 14 and an upper 16 supported therefrom, the upper 16 including a rear heel portion 18 and opposite side portions 20 and 22. The upper 16 is more flexible than the shape retentive but flexible outsole 14.

The ankle support 10 is generally U-shaped in configuration when viewed from a plan view perspective. The support element 70 is horizontally disposed and includes an edge upstanding curved bight panel or heel portion 26 interconnecting the rear ends of a pair of opposite side, generally parallel and panel-shaped edge upstanding wings 28 and 30. The wings 28, 30 include corresponding upper and lower margins 32 and 34 as well as corresponding inner and outer surfaces 36 and 38. The wings 28, 30 are concavo-convex with their concave sides opposing each other and the rear ends of the wings 28, 30 merge smoothly into the opposite ends of the curved bight or heel portion 26, the heel portion 26 including upper and lower margins 40 and 42.

As is evident from FIG. 1, the lower margin 42 is elevated appreciably above the lower margins 34, and the rear ends 44 of the upper margins 32 are elevated appreciably above the upper margin 40. The support 10 is positioned within the shoe 12 with the bight or heel portion 26 thereof closely opposing the heel portion 18 of the shoe 12.

Figure 2:
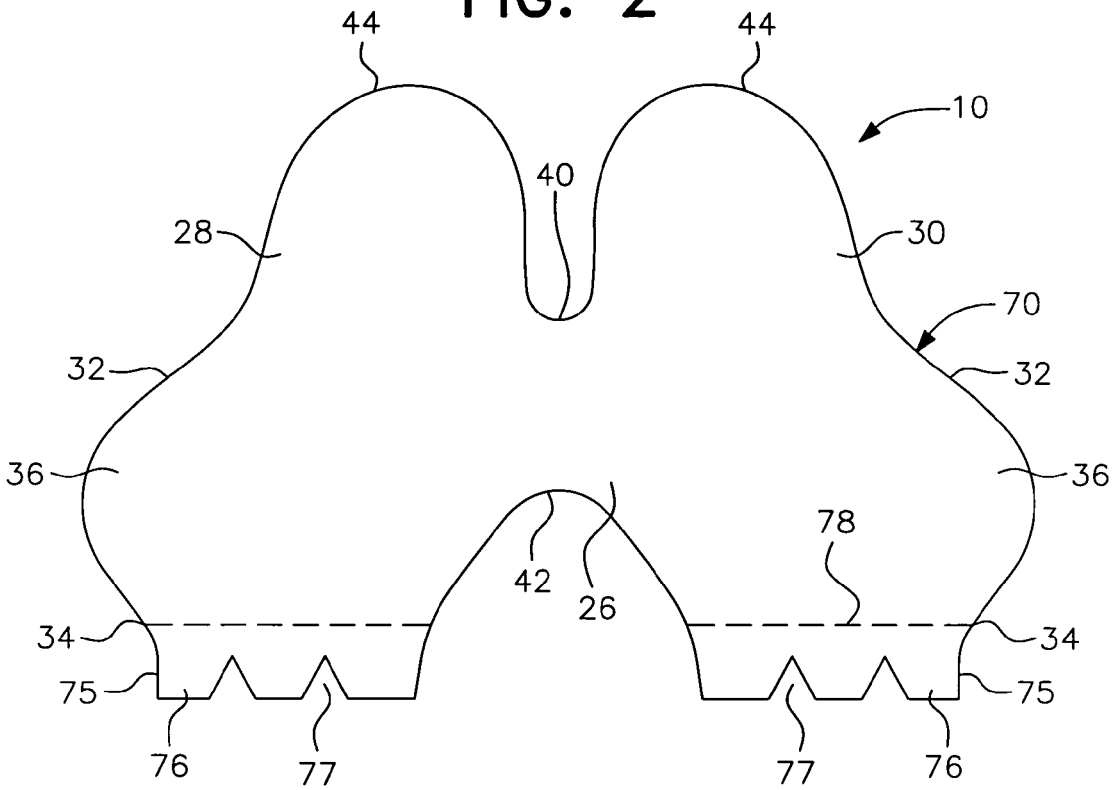
FIG. 2 is a front view of a support element of the ankle support shown in FIG. 1 before the support element is folded and assembled in the shoe.
Figure 3:
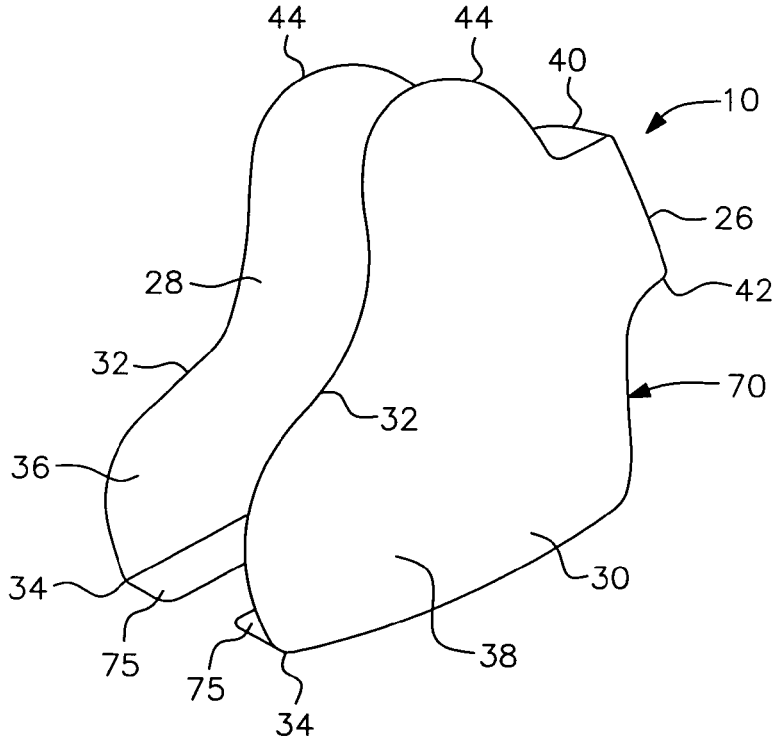
FIG. 3 is a perspective view of the support element shown in FIG. 2 as the support element is configured to be assembled within the shoe.
Figure 4:
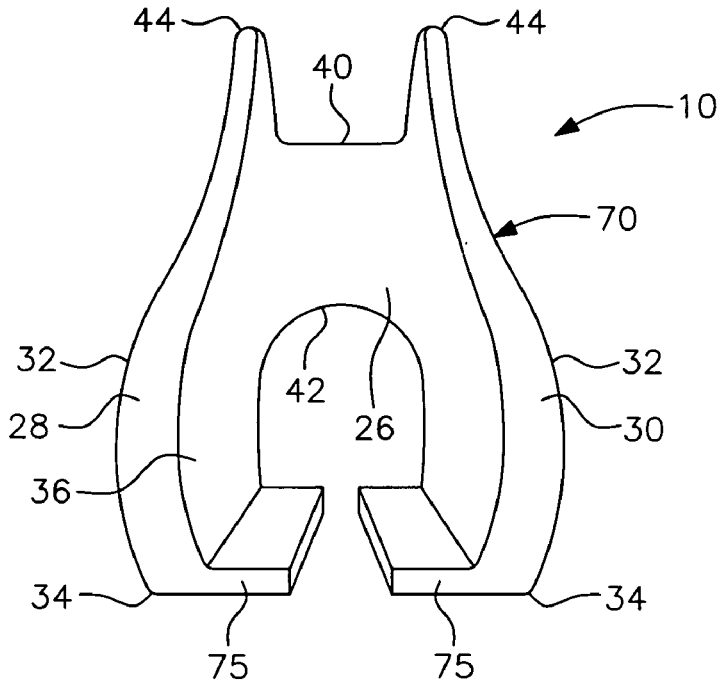
FIG. 4 is a front view of the support element shown in FIG. 3 as the support element is configured to be assembled within the shoe.

FIG. 2 shows the support element 70 in a plan form before it is folded and placed within the shoe 12. As shown in FIGS. 2, 3, 4, and 6, the support element 70 includes bottom tabs 75. The bottom tabs 75 may have a plurality of alternating protrusions 76 and notches 77 (see FIG. 2) that facilitate shaping the bottom tabs 75 for placement within the shoe.

Figure 6:
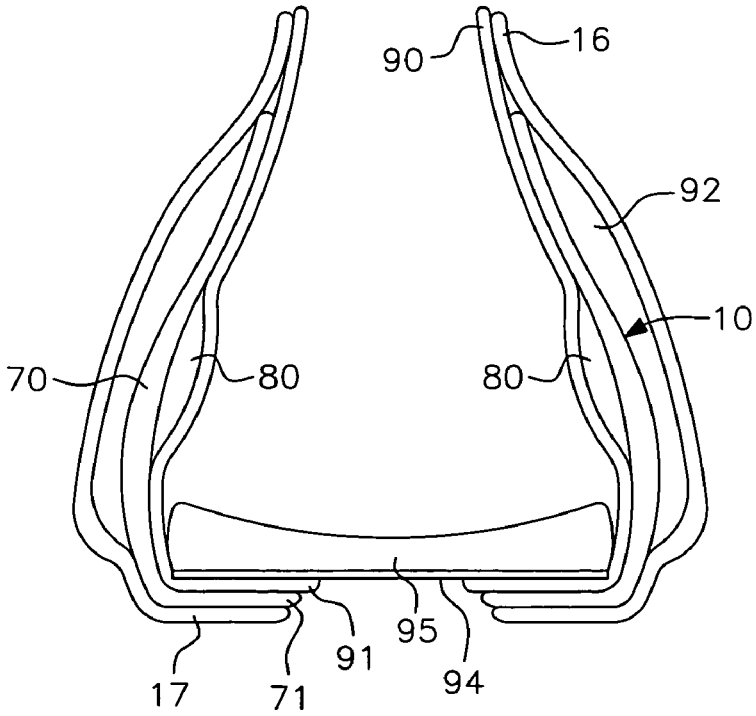
FIG. 6 is a cross-sectional rear view of the ankle support shown in FIG. 1 with the ankle support assembled within the shoe.

As shown in FIG. 6, once positioned with in the shoe 12, the bottom tab 75 is oriented substantially perpendicular to the support element wings 28, 30 and extends inwardly under the insole 94, i.e., below the insole 94 and between a portion 91 of the lining 90 and a portion 17 of the upper 16 that are substantially parallel to the insole 94, so as to ensure that the ankle support remains securely fixed in place. As indicted above, the bottom tab 75 may include the plurality of alternating protrusions 76 and notches 77 that facilitate folding the bottom tab 75 inwardly for placement under the portion 91 of the lining 90 and the portion 17 of the upper 16. The support element 70 is secured to at least one of the lining 90 and the upper 16 with an adhesive so as to ensure that the ankle support 10 remains securely fixed in place.

The upper portions of the rear ends of the wings 28, 30 of the support element 70 offer lateral support against excessive inturning of the wearer's foot about the foot's longitudinal axis, such as may sometimes cause serious sprained ankle injury.

The wings 28, 30 are relatively stiff and thereby resist, in conjunction with the associated athletic shoe 12, excessive lateral spreading of the bones of the foot forward of the ankle to thereby increase the stability of the foot and to allow the muscles of the foot to exert greater leaping forces. Still further, the overall reinforcement of the athletic shoe 12 increases the resistance of the associated foot against hyperflexure of the type that may cause ligament damage to the foot and/or ankle.

The amount of elevation of the rear ends 44 of the upper margins 32 relative to the central and forward portions of the upper margins 32 will be determined by whether the support 10 is to be utilized in, for example, a quarter-top or a high-top athletic shoe. However, in any instance, the rear ends 44 will be appreciably elevated above the central and forward ends of the upper margins 32.

The elevation and padding of the lower margin 42 of the bight or heel portion 26 is important in that it prevents pinching of the heel of the wearer of the athletic shoe 12, and also cushions the Achilles tendon area of the wearer's foot.

The support element 70 is constructed of shape retentive but partially flexible plastic or similar material. A suitable material of construction for the support element 70 is one that is flexible enough to conform to the shape of the foot but is sufficiently rigid to support the ankle. Examples of suitable materials include various thermoplastic polymers.

Figure 8:
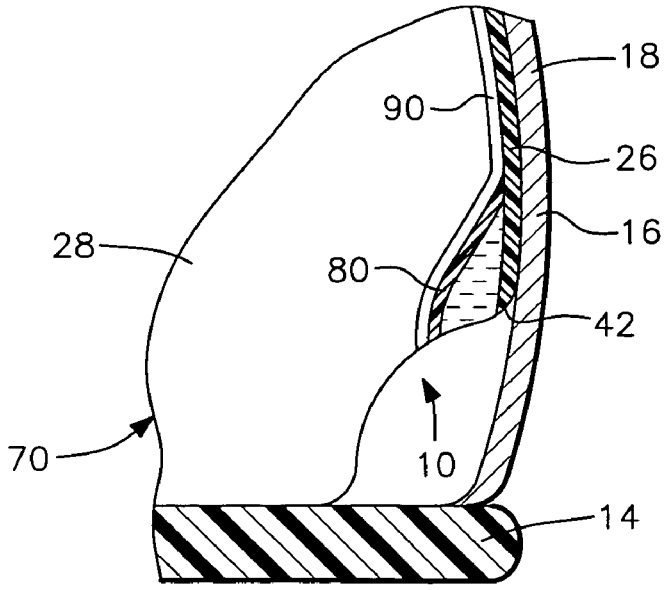
FIG. 8 is an enlarged partial cross-sectional side view of the ankle support shown in FIG. 1 with the ankle support assembled within the shoe.

The rear ends of the wing inner surfaces 36 include the cushioning element 80 secured thereto. The cushioning element 80 may be constructed of for example, gel filled flexible cushion envelopes. Further, as shown in FIG. 8, the inner surface of the bight or heel portion 26 can include a similar cushioning element 80 in the form of a neoprene or gel filled flexible envelope, a portion of the cushioning element 80 being configured to lap at least slightly outwardly over the inner surface of the lower margin 42. The envelope of the cushioning element 80 may be constructed of any suitable flexible and fluid impervious material such as rubber, plastic, or silicone.

The opposed cushioning elements 80 are positioned on the inner surfaces of the rear ends of the wings 28, 30 for directly opposing the malleolus bone areas of a foot received within the athletic shoe 12 so as to offer protection to the malleolus bone areas from impact exteriorly of the athletic shoe 12 and also for comfort measures.

Figure 9:
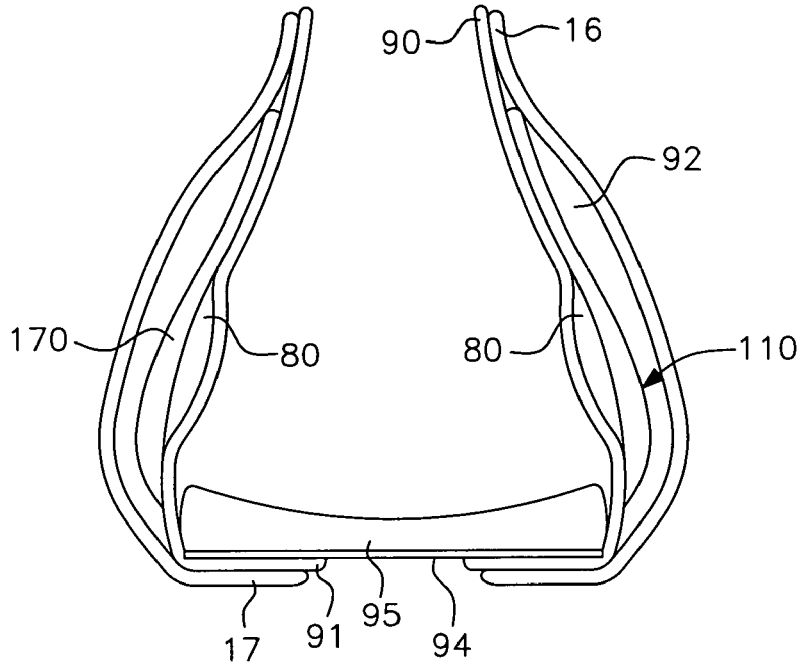
FIG. 9 is a cross-sectional rear view of an ankle support constructed in accordance with a second embodiment of the present invention with the ankle support assembled within the shoe.

Referring now specifically to FIG. 9 of the drawings, an ankle support in accordance with a second embodiment of the present invention is generally designated by reference number 110. The ankle support 110 has a support element 70 that terminates at a bottom edge of the support element wings 28, 30 and is secured to the upper 16 with stitching and/or an adhesive so as to ensure that the ankle support 110 remains securely fixed in place. In this second embodiment of the invention, only the portion 91 of the lining 90 and the portion 17 of the upper 16 are positioned below and substantially parallel to the insole 94.

The foregoing is considered as illustrative only of the principles of the invention. The shoe with which the ankle support is incorporated has been described for purposes of illustration as an athletic shoe. However, the ankle support is contemplated as being an integral part of other types of footwear in which having the ankle support and cushioning provided by the instant invention would be desirable. Such other types of footwear may include, for example, hiking shoes and boots, construction shoes and boots, and military shoes and boots.

Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. An ankle support for a shoe having an upper and an interior lining that is adapted to provide lateral ankle support for a foot in said shoe and to thereby effectively increase resistance of the foot against ligament damage and to increase the stress capacity of the foot to enable greater forces to be exerted thereby when the shoe user is attempting a leap, said ankle support comprising:

a support element that includes (i) horizontally elongated, generally parallel, panel-shaped edge upstanding wings having inner and outer surfaces and corresponding front and rear ends joined at their rear ends by an integral, curved and edge upstanding bight panel portion having inner and outer surfaces and opposite ends coextensive with the rear ends of said wings, said wings and bight panel portion each including upper and lower margins, at least the forward end portions of the upper margins of said wings being lower than the upper margin of said bight panel portion and the lower margin of said bight panel portion being higher than the lower margins of said wings, said insert wings and bight panel portion being constructed of stiff, but somewhat flexible material, and (ii) a bottom tab that is oriented substantially perpendicular to the wings and that extends inwardly so as to be located between the lining of the shoe and the upper so as to fix the ankle support securely in place; and a cushioning element covering at least some of the inner surface portions of said wings and bight panel portion, said ankle support being located internally between the upper and the interior lining of said shoe.

2. The ankle support according to claim 1, wherein the rear portions of the upper margins of said wings are elevated relative to the forward and central portions of said upper margins of said wings.

3. The ankle support according to claim 2, wherein said cushioning element includes mid-height fluent material filled flexible material packs secured over the inner surfaces of the rear ends of said wings adapted to oppose the malleolus bone areas of a human foot having the heel portion thereof substantially seated against said inner surface of said bight panel portion.

4. The ankle support according to claim 3, wherein said cushioning element includes a fluent material filled flexible material pad secured over at least the central portion of the lower margin of said bight panel portion.

5. The ankle support according to claim 4, wherein said cushioning element is located beneath said lower margin of said bight panel portion and at least slightly upwardly over said outer surface of said bight panel portion immediately above said lower margin of said bight panel portion.

6. The ankle support according to claim 2, wherein said wings are slightly vertically concavo-convex with said upper and lower margins thereof curved slightly inwardly.

7. The ankle support according to claim 1, wherein said support element is secured to at least one of said lining and said upper.

8. The ankle support according to claim 1, wherein said support element terminates at a bottom edge of said support element wings and is secured to the upper with at least one of stitching and an adhesive.

9. A shoe with an integral ankle support, said shoe comprising:

an upper including a rear heel portion, opposite side walls extending forwardly from said heel portion, and an inner lining;

a support element that includes (i) horizontally elongated, generally parallel, panel-shaped edge upstanding wings having inner and outer surfaces and corresponding front and rear ends joined at their rear ends by an integral, curved and edge upstanding bight panel portion having inner and outer surfaces and opposite ends coextensive with the rear ends of said wings, said wings and bight panel portion each including upper and lower margins, at least the forward end portions of the upper margins of said wings being lower than the upper margin of said bight panel portion and the lower margin of said bight panel portion being higher than the lower margins of said wings, said insert wings and bight panel portion being constructed of stiff, but somewhat flexible material, and (ii) a bottom tab that is oriented substantially perpendicular to the wings and that extends inwardly so as to be located between a lining of the shoe and the upper so as to fix the ankle support securely in place; and a cushioning element covering at least some of the inner surface portions of said wings and bight panel portion, said ankle support being located internally between said upper and said interior lining.

10. The shoe according to claim 9, wherein said rear portions of the upper margins of said wings are elevated relative to the forward and longitudinal central portions of said upper margins of said wings.

11. The shoe according to claim 10, wherein said cushioning element includes mid-height fluent material filled flexible material packs secured over the rear portions of the inner surfaces of said wings adapted to oppose the malleolus bone areas of a human foot disposed in said shoe and having the heel portion thereof substantially seated against said inner surface of said bight panel portion.

12. The shoe according to claim 11, wherein said cushioning element includes a fluent material filled flexible material pad secured over at least the central portion of the lower margin of said bight panel portion and lapped beneath said lower margin of said bight panel portion and slightly upwardly over said outer surface of said bight panel portion immediately above said lower margin thereof, whereby the portion of the fluent material filled flexible material pad carried by the lower margin of said bight panel portion will function to pad the opposing heel of a human foot relative to the insert and the inner surface of the heel of said upper relative to said lower margin of said bight panel portion.

* * * * *